175-40 SR
9/2/86 XR 4,608,861

United States Patent [19]
Wachtler et al.

[11] Patent Number: 4,608,861
[45] Date of Patent: Sep. 2, 1986

[54] MWD TOOL FOR MEASURING WEIGHT AND TORQUE ON BIT

[75] Inventors: William J. Wachtler, San Jose; Thomas M. Yang, Los Altos Hills, both of Calif.

[73] Assignee: MacLeod Laboratories, Inc., San Jose, Calif.

[21] Appl. No.: 668,980

[22] Filed: Nov. 7, 1984

[51] Int. Cl.[4] ..... E21B 47/00
[52] U.S. Cl. ..... 73/151; 175/40
[58] Field of Search ..... 73/151, 766, 794, 768, 73/773; 175/40, 50, 39, 320; 323/366, 369; 340/856

[56] References Cited

U.S. PATENT DOCUMENTS

| | | | |
|---|---|---|---|
| 2,083,011 | 6/1937 | Ducommun | 220/256 |
| 2,246,575 | 6/1941 | Coleman | 323/366 |
| 2,422,806 | 6/1947 | Silverman et al. | 73/151 |
| 2,633,025 | 3/1953 | Boice et al. | 175/40 |
| 2,788,662 | 4/1957 | Wiley | 73/151 |
| 3,062,052 | 11/1962 | Kolb | 340/856 |
| 3,686,942 | 8/1972 | Chatard et al. | 73/151 |
| 3,968,473 | 7/1976 | Patton et al. | 367/83 |
| 4,051,456 | 9/1977 | Heilhecker et al. | 340/856 |
| 4,220,381 | 9/1980 | van der Graff | 340/856 |
| 4,265,110 | 5/1981 | Moulin | 73/151 |
| 4,359,898 | 11/1982 | Tanguy et al. | 73/151 |

OTHER PUBLICATIONS

Deily, New Drilling-Research Tools Shows What Happens Down Hole, The Oil and Gas Journal, Jan. 1968, pp. 55–64.

Oberg, The Determination of Stresses in Oil Well Casing in Place, May 1947.

*Primary Examiner*—Jerry W. Myracle
*Assistant Examiner*—Robert R. Raevis
*Attorney, Agent, or Firm*—Hamrick, Hoffman, Guillot & Kazubowski

[57] ABSTRACT

A device for measuring the weight and torque on bit while drilling includes an outer bored cylindrical sleeve coaxially connectable into a drill string above a drill bit and an inner bored cylindrical sleeve welded coaxially within the outer sleeve. Strain gages located on the exterior surface of a necked-down section of the inner sleeve are isolated in an ambient pressure environment within annulus between the sleeves. Temperature compensation is accomplished by resistance temperature detectors sensing temperatures at the exterior surfaces of the respective sleeves.

21 Claims, 6 Drawing Figures

MWD TOOL FOR MEASURING WEIGHT AND TORQUE ON BIT

BACKGROUND OF THE INVENTION

1. Field Of The Invention

The invention relates to a tool for measuring weight and torque experienced by a drill bit in a well drilling string while drilling.

2. Description of the Prior Art

The compressive and torque loads experienced by a bit while drilling are valuable data useful for determining the nature of geological strata encountered, controlling the direction of drilling, and optimizing the performance of the drill.

Various measure-while-drilling (MWD) tools have been developed for measuring the compressive and torque loads experienced by a drill bit while drilling. Such MWD tools typically are incorporated into a drill string immediately above the drill bit, and include one or more mandrel elements serially incorporated into the drill string by means of one or more threaded joints. (see U.S. Pat. Nos. 3,686,942 and 3,827,294). Often such tools include oil filled annuli with annular pistons for transmitting drilling fluid pressure to the data generating region of the tool (see U.S. Pat. Nos. 3,968,473 and 4,120,198).

Typically, electrical signals generated by the measuring devices of the tool, (strain gages and potentiometers) are initially processed down-hole in a data processing module incorporated into the drill string up or down string from the tool. The possessed data signals are then electromagnetically and/or acoustically telemetered to the ground surface via the drill string or drilling mud.

The primary disadvantages of existing MWD tools for measuring weight and torque on bit relate to nonlinear effects distorting the measurement response due to: (1) Hysteretic error inherent in threaded joints and (2) the unpredictability of the frictional responses of seals between movable elements of the tool.

Also, the existing MWD tools, rely heavily on the integrity of sliding pressure seals isolating the measuring devices (strain gages and potentiometers) in the measuring region from the drilling mud.

Other disadvantages of existing MWD tools relate to the absence of temperature sensors capable of providing data for eliminating temperature related effects observed by the strain gage.

Another major disadvantage of existing MWD tools for measuring weight and torque on bit is their insensitivity to small variations in actual load. In particular, the mandrel element of such tools (which generate the strain data) are designed to withstand the same load as the drill bit without significant deformation. Accordingly, strain gages sensing the deformation of such mandrels responsive to load simply can and do not generate data reflecting small variations in load.

In order to enhance the sensitivity of the detector (strain gage) response, techniques have been utilized to "amplify" the actual deformation experienced by the mandrel element (see U.S. Pat. No. 3,827,294). Other enhancement techniques contemplate serially loading one or more relatively deformable mandrels in a telescoping arrangement around a load bearing member. In such arrangements the strain gages sense deformation of the deformable mandrel to a point where the mandrel engages the load bearing element which then assumes the load. (see U.S. Pat. No. 3,827,294)

However, such existing techniques for enhancing the sensitivity of the strain gages to small variations load in such MWD tools are mechanically complex and are difficult of calibration. For example the data response of the "load responsive element" described in U.S. Pat. No. 3,827,294 depends upon the initial load impressed upon it. In telescoping arrangements, the data response is degraded by deformation of the mandrel element at the point of engagement with the load bearing element.

SUMMARY OF THE INVENTION

An MWD tool for measuring weight and torque experienced by a drill bit is described which includes an outer cylindrical sleeve coaxially connectable into a drill string above the drill bit, an inner cylindrical sleeve welded coaxially within the outer sleeve, and strain gages bonded to the exterior surface of the inner sleeve in an isolated annulus between the respective sleeves. Resistance temperature detectors sensing temperatures at the surface of the respective sleeves provide data for adjusting the data response of the strain gages.

In a particular embodiment of the invented tool, the inner sleeve has a compound configuration designed to concentrate strain experienced to a certain region of the tool, yet minimize distortion due to hoop stresses. High pressure electrical feedthroughs, permit electrical connection of the strain and temperature detectors within the annulus to signal processing module incorporated into the drill string up or down string from the tool.

The principle advantage of the invented tool relates to the fact that the inner measuring element continuously experiences both compressive and torsional loads in parallel with the outer sleeve of the tool. This permits the inner cylindrical sleeve to be configured such that distortion or strain experienced by it is enhanced in a certain region of the sleeve. It also permits detection of variations in load of a pre-determined magnitude.

Another advantage the invented tool relates to the fact that there are no moving parts, threaded joints, or dynamic seals between the responding elements of the tool. Accordingly the response of the tool to load is linear and continuous without hysteretic error.

Another significant advantage of the invented tool relates to the isolation of the active electrical elements (strain & temperature gages) in an ambient pressure environment within an annulus between the two cylindrical sleeves. The isolated annulus between the inner and outer sleeve may also serve as an ambient pressure, environmental enclosure for other sensors and electronics, e.g. signal amplifying devices for processing of electrical signals from the strain gages and temperature detectors.

Still other advantages of the invented tool relate to collection of temperature data at the exterior surfaces of the respective sleeves for adjusting data from the strain gages to compensate for thermally induced strains.

The invented tool also has an open central bore allowing unencumbered passege of drilling mud.

Finally the welded construction of the tool renders it essentially immune to wear.

Still other features, objects and advantages of the invented MWD tool for detecting the magnitude of compressive and torsional loads experienced by a drill bit down-hole may be ascertained with reference to the drawings and the description of a preferred embodiment of the tool infra.

DESCRIPTION OF A PREFERRED EMBODIMENT

Figure 1:
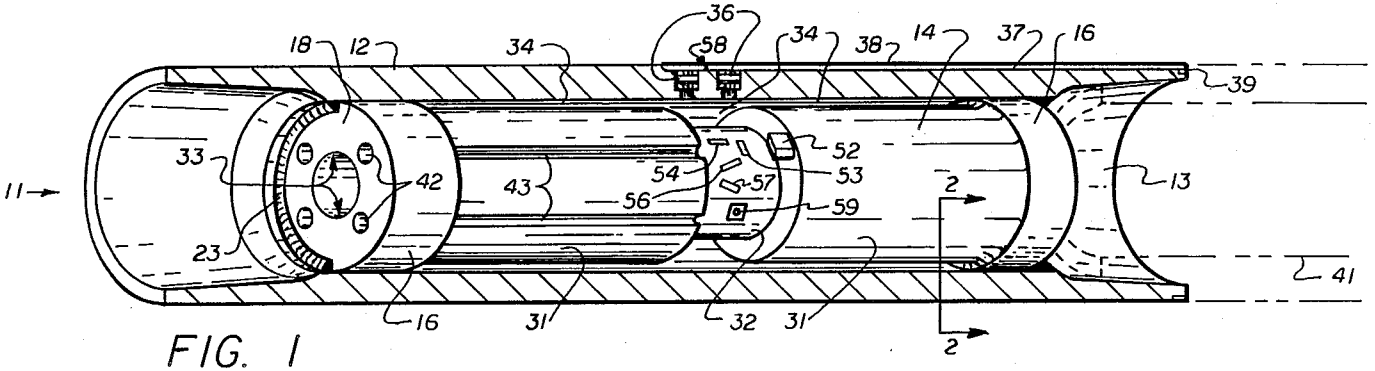
FIG. 1 shows a cut away perspective view of the invented tool.

Referring to FIG. 1, The invented MWD Tool 11 includes an outer cylindrical sleeve 12 with standard API threaded box joints 13 at either end. An inner cylindrical sleeve 14 is coaxially welded within the outer sleeve 12. In more detail, referring to FIG. 2, the inner cylinder 14, includes an annular shoulder 16, with an outer diameter essentially equal to the inner diameter the outer sleeve 12. A shim 17 placed between the annular shoulder 16, and the inner surface of the sleeve 12, to assure coaxial orientation of the respective sleeves. It is desirable that there be less than 0.001 in. clearance between the exterior surface of the annular shoulder 16, and the interior surface of the cylindrical sleeve 12.

The distal end 18, of the shoulder 16, is relieved annularly to define a groove 19 in combination with the interior surface 21 of the outer sleeve for receiving the root 22, of an annular weld 23. The weld 23 mechanically couples the inner sleeve 14, to the outer sleeve 12.

Figure 2:
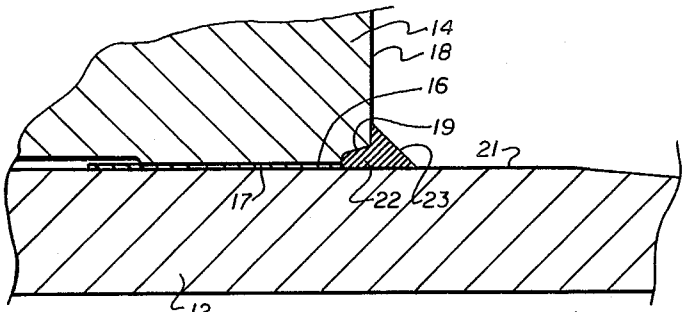
FIG. 2 is an enlarged cross-sectional view taken along 2—2 of FIG. 1 illustrating the weld between the inner and outer cylindrical sleeves of the tool.

As shown in FIG. 2, the weld 23, extends beyond the distal end 18 of the shoulder 16, and inwardly on to the face of the distal end. The outwardly facing surface of the annular weld 23, is not subjected to a compressive load when the tool is connected into a drill string.

Figure 3:
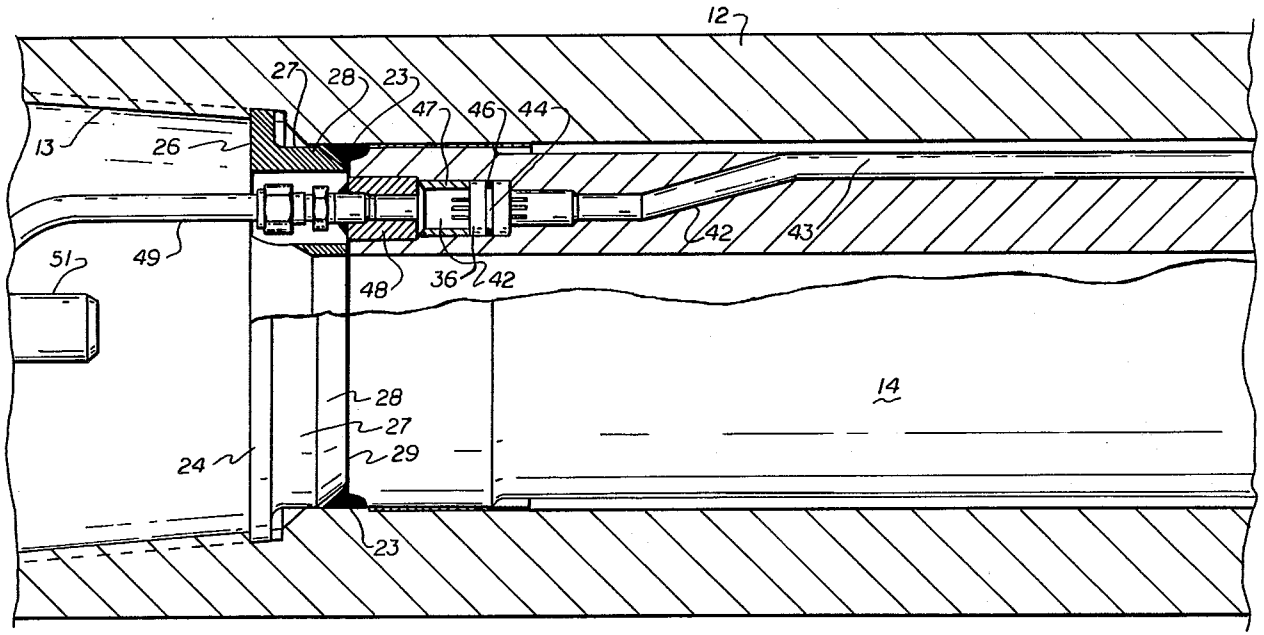
FIG. 3 is an enlarged cross-sectional view showing the high pressure electrical feed through allowing connection to a signal processing and/or telemetrey system up/down string from the tool.

Referring to FIG. 3, when the tool 11 is connected into a drill string utilizing the standard API threaded box joint 13, a retainer ring 24 is coaxially received at the base of the box joint 13. The retainer ring 24, includes an exterior shoulder 26, adapted to receive the end face of a male element of a standard API box joint. The cylindrical body 27, of the retainer ring has essentially the same outer diameter as the inner diameter of the outer sleeve 12. The interior shoulder 28 of the retainer ring is relieved annularly to create an incline face 28, such that it does not come in to contact with the inclined surface of the annular weld 23. The end face 29 of the retainer ring 24, abuts, but does not load the face of the distal end 18 of the inner cylindrical sleeve 14.

Referring back to FIG. 1, of the inner cylindrical sleeve 14 has a compound configuration, i.e. the annular shoulders 16 have an outer diameters essentially equal to the inner diameter of the outer sleeve 12, transfer cylindrical sections 31 have outer diameters less than the inner diameter of the outer sleeve 12, and the "necked-down" measuring section 32 bridging between the transfer sections 31 has an outer diameter somewhat less than that of the transfer sections 31.

Both the outer and inner cylindrical sleeves 12 and 14, are bored cylinders and are each an integral piece of material. The inner bore of the sleeve 33 has exactly the same diametric dimension in each of its sections 16, 31, and 32. The outer cylindrical sleeve 12 has a constant diameter between the annular welds 23.

The weldment comprising the inner and outer sleeves 12 and 14 of the tool 11 should be designed to withstand the compression and torsion loads experienced at the end of a drill string proximate the drill bit. Suitable materials for the outer and inner sleeves 12 and 14 include weldable non magnetic stainless steels and low carbon alloy steels such as Gammaloy T-287, Armco Nitronics 32, Babcock & Wilcox Croloy 299 and AISI 4130 Alloy Steel.

Assuming that strain due to compression and torsion does not exceed the elastic limit of the weldment, the outer and inner sleeves 12 & 14 may be considered a system of springs. In particular, the outer sleeve 12 and the inner sleeve 14 may be combined into an equivalent spring by the relationship:

$$Kev = Kos + Kis;$$

Where Kev is the spring constant of the equivalent spring and Kos and Kis are the respective spring constants of the outer and inner sleeves 12 and 14.

Similarly, the compound configuration of the inner sleeve 14, can be combined into an equivalent spring using the relationship;

$$1/Kis = 1/Ka1 + 1/Ka2 + 1/Kt1 + 1/Kt2 + 1/Km$$

Where Ka1 and Ka2 are the spring constants of the annualar shoulders 16, Kt1 and Kt2 are the spring constants of the transfer sections 31, and Km is the spring constant of the measuring section 32.

The weldment comprising the welded together inner and outer cylindrical sleeves 14 and 12, also creates an annulus 34 between the interior surface of the outer sleeve 12, and the exterior surfaces of the inner sleeve 14, which is completely isolated from the external environment. The ambient pressure and composition of gases within the annulus may be adjusted via one of the electrical feed-through ports. Under operating conditions, gas pressure within the annulus 34 will increase due to the increased temperature down hole.

The pressure of drilling mud passing through the central bore 33 of the inner sleeve 14, can be as high as 20,000 psi down hole. Accordingly differential pressure between the annulus 34 and the inner bore of the inner sleeve 14 under normal operating conditions gives rise to a radial stress tending to expand the inner sleeve 14. The thickness of the measuring section 32 wall should be sufficient to maintain a safe strain level to such radial or hoop stresses.

Another factor to consider for determining the wall thickness of the measuring section 32 of the inner sleeve includes the desired range of measurement. In particular, as discussed above the compound configuration of the inner sleeve 14 can be analytically described as a plurality of springs connected serially. In general, the thicker the wall thickness, the stronger the spring. Maintaining the analogy, when a load, whether compression, tension or torsion is experienced by the serial combination of springs, the deflection or deformation (strain) of the system will be greatest at the weakest spring. In the case of the inner sleeve 14, the weakest spring would be the measuring section 32. Accordingly under stress, the measuring section will experience more deformation (strain) than the transfer sections 31 and the annular shoulders 16. Specifically, deformation of a solid material within its elastic limit is inversly proportional to its cross sectional area perpendicular to the applied stress and directly proportioned to its length.

Also the tool should be designed to withstand a maximum conceivable load. In particular, the inner and outer sleeves carry the load in parallel. Accordingly, over all deformation (strain) experienced by the tool may be adjusted between the inner and outer sleeves by suitable choice of wall thickness (cross-sectional area) of the respective sleeves. The ratio of load carried by the inner sleeve 14 to that carried by the outer sleeve 12, should generally range from 0.25 to 0.75.

Summarizing, the wall thickness and length of the measuring section 32 of the inner sleeve 14 are selected:

(a) To eliminate the possibility of failure due to internal drilling fluid pressures.

(b) To maintain deformation of the measuring section within its elastic limit;

(c) To provide sufficient deformation (strain) for generation of a detectable signal for the minimum variation in load desired to be detected (sensitivity);

(d) To provide sufficient space for packaging the strain gages, wire and other desired electronics.

For inner and outer sleeves composed of Gamalloy T-287 a measuring section with a length of 3.50 inches and a wall thickness of 0.50 inches where the overall length of the inner cylinder is 32.50 inches has been found acceptable.

Returning now to FIG. 1, the annulus 34 between the inner and outer sleeves provides an ambient pressure environment suitable for many purposes. For example, high pressure electrical feed through ports 36 may be radially drilled through the outer sleeve 12 to provide electrical access into the annulus 34 from outside the outer sleeve 12.

As shown in FIG. 1, there is also a longitudinal groove 37 cut into the exterior surface of the outer sleeve 12 to accommodate electrical wiring. The groove 37 communicates between the high pressure electrical feed through ports 36 and an annular recess 39 also cut into the exterior surface of the outer sleeve 12 at one of its ends. The grooves 37 and 39 have covers 38 for protection. Accordingly, electrical connection can be made between elements within the annulus 34 and an exterior up/down string element 41.

Alternatively, electrical access to the annulus 34, may be via holes 42 drilled through the annular shoulder 16 of the inner sleeve 14. In this case longitudinal grooves 43 may be cut into the exterior surface of the transfer sections 31 to accomodate electrical wires. Here, electrical connection can be made from the annulus 34 to the interior bore of the drill string.

In particular, referring to FIG. 3, illustrated is a high pressure electrical feed through 36 coaxially received within the part 42 through the annular shoulder of the inner sleeve 14. The feed through 36 includes an annular groove 44 and and "O" ring 46. A retainer ring 47 secures the feed through 36 in the base of the port 42. Threaded into the entrance of the port 42 is a typical adapter 48 which is connected to a tube 49. The tube 49 in turn communicates with a male adapter weldment 51 mounted within the up/down string element connected to the tool 11 via the API threaded box joint 13 at either end of the tool.

The annulus 34 may also be utilized for making electrical connection between components within the central bore of the drill string and components on the exterior surface of the drill string via the radial high pressure electrical feed through ports 36 into the annulus 34 and then into the interior of the drill string via the ports 42 through the annular shoulder 16 of the inner sleeve 14.

Temperature insensitive electrical signal processing devices may be mounted within the annulus 34 for processing the electrical response of detectors and the like within the annulus, as well as the exterior signal responses communicated into the annulus via the high pressure electrical feed through ports 36/42 up/down string from the tool. A representative electrical signal processing module 52 is symbolically indicated in FIG. 1 mounted on the perpendicular shoulder of one of the transfer sections 31 of the inner sleeve 14.

In FIG. 1, the strain gages 53 and 54 are bonded to the exterior surface of the measuring section 32 of the inner sleeve 14 for determining weight on bit. The strain gage 54 is aligned for sensing axial deformation while the strain gage 53 is aligned to sense circumferential deformation of the section. Identical strain gages 53 and 54 identically orientated are bonded on the diametrically opposite exterior surface of the measuring section 32 (not shown).

Figure 5:
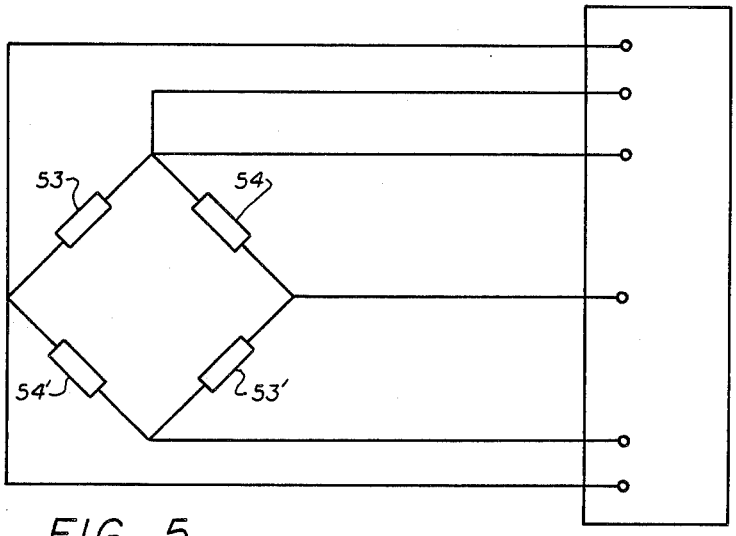
FIG. 5 is an electrical schematic of the strain gage bridge for sensing weight-on-bit.

FIG. 5, schematically illustrates the four strain gages for sensing weight-on-bit (WOB) connected in a Wheatstone bridge network where the bridge arms consist of the four active strain gages. Since the two longitudinal oriented gages 54 are mounted diametrically opposite from each other on the measuring section 32, strains due to bending automatically cancel out. The two circumferentially oriented gages 53, called "Poisson Gages" generate signals which compensate for thermal expansion and contraction of the measuring section 32.

The electrical output, Vo, in millivolts for the Wheatstone bridge network of (WOB) strain gages is given by the expression:

$$Vo=(VFe(1+n)(10^{-3})/2+Fe(1+n)(10^{-6}))$$

Where V is the bridge exitation in volts, F is a nondimensional gage factor, n is the non dimensional Poission ratio, e is strain level (in/in$\times 10^{-6}$, and Vo is the output voltage in millivolts.

The torque-on-bit (TOB) is also sensed by four strain gages 56 an 57 bonded to the surface of the measuring section of the inner sleeve 14. The strain gages 56 and 57 (FIG. 1) are oriented perpendicularly with respect to each other, and at an angle of 45 degrees with respect to the longitudinal axis of the measuring section 32. A pair of gages 56' and 57' are similarily bonded to the exterior surface of the measuring section diametrically opposite the pair 56 and 57 (not shown in the figure).

Figure 4:
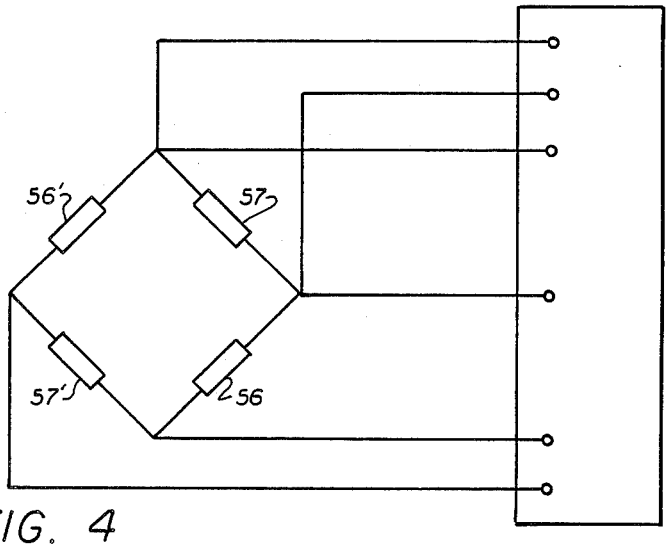
FIG. 4 is an electrical schematic of the strain gage bridge for sensing torque-on-bit.

FIG. 4, shows a schematic of four gages 56,56' and 57, 57' for sensing torque-on-bit (TOB) connected in a Wheatstone bridge network with the active gages forming the bridge arms. Because of their orientation, signals generated due to axial strain and/or bending cancel.

The electrical output for the Wheatstone bridge configuration of the (TOB) strain gages is given by the expression:

$$Vo=VFe\times 10^{-3}$$

Figure 6:
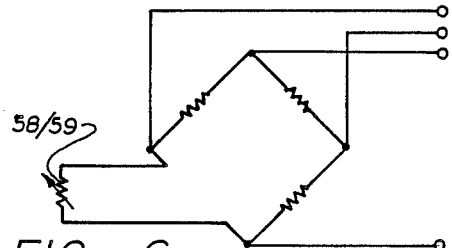
FIG. 6 is an electrical schematic showing resistance temperature detector bridge for sensing the temperature at the surface of the inner and outer sleeves.

Under normal operating conditions downhole, a temperature difference exists between the cool drilling mud flowing downwardly through the central bore of the drill string and the hot drilling mud flowing upwardly in the annulus between the exterior surface of the drill string and the well hole. The drilling mud temperatures, in addition to being valuable data to a driller, will cause deformation which is not indicative of either weight or torque on bit. In order to eliminate or compensate for the effects of such a temperature difference, a resistance temperature detector 58 is mounted to sense the temperature at the exterior surface of the outer sleeve 12. A similar resistant temperature detector 59 is mounted on the exterior surface of the measuring section 32 of the inner sleeve 14. The sensing element of the resistance temperature detector is a platinum wire positioned strain-free in a platinum outer case which in turn is either spot welded, cemented or clamped to the surface of a particular section of the sleeve. The schematic of FIG. 6, shows that each resistance temperature detectors (RTD) 58 and 59 forms an active arm of a Wheatstone bridge network.

Strain due to the temperature difference between the outer sleeve 12 and the inner sleeve is determined from the relationship:

$$La = Lg(To - Ti)/(1/Kos + 1/Kis);$$

where La is the apparent load due to the temperature difference between the inner and outer sleeves, L is the length of the inner sleeve, g is the thermal expansion coefficient, To is the measured temperature at the exterior surface of the outer sleeve 12, Ti is the measured temperature at the exterior surface of the measuring section 32 and Kos and Kis are the respective spring constants of the inner and outer sleeves.

Temperature of the drilling mud flowing downwardly through the drill string can be derived from the sensed temperature of inner sleeve. The temperature of the drilling mud flowing upwardly outside the drill string can be derived from the sensed temperature of the outer sleeve.

The electrical output of the strain gages is also affected by the following loads:

(a) A pressure differential effect due to the jet flow of mud through the drill bit nozzels which imposes both a tensile and a torsional load on the drill string;

(b) Bottom hole assembly effects due to drill string components below the tool.

The electrical responses of the strain gages 53–56 and the RTD's 58 and 59 may be initially processed in the signal processing module 52, and then transmitted via electrical wiring throughout the weldment 51 where the data is processed and telemetered to the ground surface.

While the invented MWD tool has been described in context of a particular embodiment, variations and modifications of the tool may be made without departing from the scope of the invention as set forth in the appended claims.

We claim:

1. A tool for measuring compression and torsion loads experience by a drill bit while drilling comprising, in combination:

an outer sleeve with a central bore, connectable into a drill string, an inner sleeve having an annular shoulder at each distal end of a configuration similar and approximately congruent to that of the central bore of the outer sleeve, coaxially located within the central bore of the outer sleeve, the inner sleeve also having a central bore through which drilling mud may flow, means for securing the annular shoulders of the inner sleeve within the central bore of the outer sleeve whereby the inner and outer sleeves support and experience compression and torsion load in parallel, a first means for generating an electrical signal responsive to axial strain of the inner sleeve, a second means for generating an electrical signal responsive to torsional strain of the inner sleeve, and means for transmitting the generated electrical signals to a ground surface station.

2. The tool of claim 1 further including temperature sensing means for generating electrical signals responsive to temperatures of the inner and outer sleeves.

3. The tool of claim 2 wherein the temperature sensing means include a first resistance temperature detector mounted in a recess defined into the exterior surface of the outer cylinder and a second resistance temperature detector bonded to the exterior surface of the inner sleeve, each resistance temperature detector forming an active arm of a Wheatstone bridge electrical network.

4. The tool of claim 3 wherein the detectors are located on the respective sleeves for generating electrical signals from which temperatures of drilling fluids flowing downwardly through and upwardly around the drill string can be derived.

5. The tool of claim 1 wherein an annulus exists between exterior surfaces of the inner sleeve and interior surfaces of the outer sleeve, and the respective means for generating electrical signals responsive to axial and torsional strains of the inner cylinder are located within the annulus.

6. The tool of claim 5 wherein the annulus contains a gas.

7. The tool of claim 6 wherein the gas within the annulus is inert.

8. The tool of claim 5 further including at least one external port radially cut through the outer sleeve permitting axis into the annulus and a first high pressure electrical feed through plug closing the external port, whereby electrical signals may be conducted to and from the annulus from outside the tool.

9. The tool of claim 8 wherein the exterior surface of the outer sleeve includes an annular recess cut into at least one of its distal ends, and a groove communicating between the port and the annular recess for accommodating electrical wiring connectable to a component up/down string from the tool, and a cover secureable over the annular recess and groove for protecting such wiring from drilling mud and debris flowing exterior the drill string.

10. The tool of claim 5 or 8 further including an internal port defined through the inner sleeve permitting access into the annulus from the central bore of the inner sleeve and a second high pressure electrical feed through plug closing the internal port whereby electrical signals maybe conducted to and from the annulus from within the drill string.

11. The tool of claim 10 wherein the second high pressure electrical feed through plug closing the internal port includes means for connecting to tubing, whereby electrical wiring exiting form the annulus is received and protected from drilling mud flowing downwardly through the drill string.

12. The tool of claim 11 further including means for prcessing electrical signals located within the annulus.

13. The tool of claim 5 wherein each annular shoulder of the inner sleeve includes an annular recess cut into its exterior surface at the distal end thereof to define an annular channel when positioned within the central bore of the outer sleeve, and further including a continuous weld securing the distal ends of the inner sleeve coaxially within the central bore of the outer sleeve, the weld having a root extending into and filling the annular channel and forming an inwardly extending annular shoulder whereby an integral bond is formed securing the distal ends of the inner sleeve to the outer sleeve.

14. The tool of claim 13 further including a shim between the annular shoulders at the distal ends of the inner sleeve and walls defining the central bore of the outer sleeve for positioning the inner sleeve coaxially within the outer sleeve before and during welding.

15. The tool of claim 13 wherein the central bore of the the inner bore of the inner sleeve has identical cross-sectional dimensions along its length, and wherein the inner sleeve includes a measuring section of a first wall thickness, (Tm), and transmitting sections of a second wall thickness, (Tt), integral with and bridging between the measuring sections and the annular shoulders at the distal ends of the sleeve, where Tm is less than Tt.

16. The tool of claim 15 wherein the outer sleeve has a central bore with identical crosssectional dimensions along its length and wherein the outer sleeve has a wall thickness, (To), where (Tm) is less than Tt is less than To.

17. The tool of claim 15 wherein the first and second means for generating electrical signals responsive to axial and torsional strains respectively are located on, and sense strain of the measuring section of the inner sleeve.

18. The tool of claim 17 wherein ratios of Tm:Tt:To are adjusted for providing an elastic strain response in the measuring section of the inner sleeve responsive to a minimum change of load desired to be detected.

19. The tool of claim 1 wherein the first means for generating an electrical signal responsive to axial strain of the inner sleeve includes four strain gauges bonded to an exterior surface of the inner sleeve, two of the strain gauges being positioned parallel to the axes of the inner sleeve on diametrically opposite surfaces, the remaining two strain gauges being oriented perpendicularly with respect to the axis of the inner sleeve also on diametrically opposite surfaces of the sleeve, the strain gauges being electrically connected in a Wheatstone bridge network with bridge arms consisting of the four strain gauges.

20. The tool of claim 1 wherein the second means for generating a electrical signal responsive to torsional strain of the inner sleeve comprises four strain gages bonded to the exterior surface of the inner sleeve, a first pair of strain gages being oriented perpendicularly and at an angle of 45 with respect to the longitudinal axis of the inner sleeve, the remaining pair also being oriented perpendicularly with respect to each other and at a angle of 45 with respect to the longitudinal axis of the inner sleeve bonded to the surface diametrically opposite the first pair of strain gages, the strain gages being electrically connected in a Wheatstone bridge network with each strain gage forming an arm of the bridge network.

21. A tool for measuring compression and torsion loads experienced by a drill bit comprising a first longitudinal member having means located at each distal end for mechanically receiving and coupling the member into a drill string above the drill bit, a second longitudinal member with each distal end mechanically bonded to the first longitudinal member, whereby the first and second longitudinal members support and experience compression and torsion loads in parallel, means for sensing strain of the second longitudinal member generating an electrical signal, means for sensing the temperature difference between the first and second longitudinal member generating an electrical signal whereby strain of the second longitudinal member due to such temperature difference can be determined, and means for transmitting the electrical signals from the respective strain and temperature sensing means to a ground surface station.

* * * * *